United States Patent [19]

Suzuki et al.

[11] Patent Number: 4,565,174

[45] Date of Patent: Jan. 21, 1986

[54] FUEL INJECTION CONTROL APPARATUS

[75] Inventors: Makoto Suzuki, Mishima; Kenichi Nomura, Susono, both of Japan

[73] Assignee: Toyota Jidosha Kabushiki Kaisha, Japan

[21] Appl. No.: 667,746

[22] Filed: Nov. 2, 1984

[30] Foreign Application Priority Data

Dec. 26, 1983 [JP] Japan ..... 58-250331

[51] Int. Cl.[4] ..... F02B 3/02

[52] U.S. Cl. ..... 123/478; 123/480; 123/493

[58] Field of Search ..... 123/478, 480, 493, 494, 123/339, 472, 438

[56] References Cited

U.S. PATENT DOCUMENTS

| | | | |
|---|---|---|---|
| 4,202,295 | 5/1980 | Kondo et al. | 123/478 |
| 4,392,467 | 7/1983 | Miyagi et al. | 123/493 |
| 4,436,073 | 3/1984 | Miyagi | 123/480 |
| 4,442,818 | 4/1984 | Kashiwaya et al. | 123/493 |
| 4,450,258 | 5/1984 | Yaegoshi et al. | 123/480 |
| 4,473,052 | 9/1984 | Kamiyama et al. | 123/478 |
| 4,503,479 | 3/1985 | Otsuka et al. | 123/480 |

OTHER PUBLICATIONS

Toyota's prior application Ser. No. 06/357,148, filed Mar. 11, 1982, Title: Fuel Injection Method in Electronic Control Engine.

*Primary Examiner*—Raymond A. Nelli

*Attorney, Agent, or Firm*—Parkhurst & Oliff

[57] ABSTRACT

A fuel injection control apparatus for use of an engine. The apparatus varies a minimum amount of fuel to be injected into the engine according to such conditions as the engine speed increases or decreases. When the engine speed increases, a first minimum amount of fuel is set in low and intermediate engine speed zones and the first minimum amount is converted to a second minimum amount of fuel which is less than the first minimum amount in a high engine speed zone. Contrary to this, when the engine speed decreases, the second minimum amount of fuel is set in high and intermediate engine speed zones, and the second minimum amount of fuel is converted into the first minimum amount of fuel in the low engine speed zone. Thus, according to the increase or decrease in an engine speed, a minimum amount of fuel is varied with a hysteresis.

4 Claims, 5 Drawing Figures

FUEL INJECTION CONTROL APPARATUS

BACKGROUND OF THE INVENTION

The present invention relates to a fuel injection control apparatus, and more particularly to a fuel injection control apparatus which is employed in a fuel injection type engine.

There has been known a fuel injection control apparatus which has an air flow meter for detecting an amount of suctioned air into an engine, a sensor for detecting an engine speed. The prior fuel injection control apparatus determines the amount of the fuel to be injected according to the amount of the detected intake air and the amount of the detected engine speed. In such a prior fuel injection control apparatus, when a vehicle is in the decelerated condition, the amount of the injected fuel is too small compared with the necessitated amount of fuel, and this happens to cause a lean mixture. In other words, when a throttle valve fully closes and the vehicle is in the decelerated condition, a compensation plate within an air flow meter closes by the angle which is greater than that in the proper condition. As a result, the air flow meter indicates the amount of the suctioned air which is less than the amount of the actually suctioned air. If the amount of the detected intake air is small, the amount of the injected fuel also decreases according to the decrease in the amount of the detected air. Thus, if a lean mixture is supplied into an engine, this causes the vibration of a vehicle body to impair the drivability of the vehicle, because an engine brings a torque change.

To dissolve the above-described disadvantages, there has been proposed a fuel injection control apparatus which sets the smallest amount of an injected fuel and regulates the amount of the injected fuel so that the amount of the injected fuel may not become less than the smallest amount. In general, the smallest amount of the injected fuel varies according to an engine speed. In detail, when the engine speed is relatively low, the smallest amount of the injected fuel necessitates a relatively great value in order not to generate the engine torque fluctuation. Contrary to this, when the engine speed is relatively high, it is required to decrease the noxious content contained in the exhaust gas, instead of dissolving the problem of the engine torque fluctuation. Hence, when the engine speed is relatively high, the smallest amount of the injected fuel is necessitated a relatively small value. There has been such a fuel injection control apparatus as the apparatus varies the smallest amount of the injected fuel, which is set according to the variation of the engine speed.

However, even in the case that the smallest amount of the injected fuel varies according to the engine speed, when a throttle valve temporarily opens and the engine speed temporarily increases, the smallest amount of the injected fuel is set to the smallest amount which is set for the high engine speed as the engine speed temporarily increases. After the engine speed temporarily increases, the engine speed promptly drops. In this condition, the smallest amount of the injected fuel for the high engine speed is set and the relatively small amount of fuel is injected. This causes the engine torque fluctuation to generate the vibration of the vehicle body.

SUMMARY OF THE INVENTION

The present invention was made in view of the foregoing background and to overcome the foregoing drawbacks. It is accordingly an object of this invention to provide a fuel injection control apparatus which decreases a vibration of a vehicle body when the engine speed varies.

To attain the above objects, a fuel injection control apparatus according to the present invention has a first means which detects an amount of an intake air suctioned into an engine, and a second means which detects an engine speed. Further, the apparatus has a third means which determines an engine speed zone. When the detected engine speed is less than a first predetermined engine speed, it is determined that it is in a low engine speed zone. When the detected engine speed is greater than a second predetermined engine speed which is set to be greater than the first predetermined engine speed, it is determined that it is in a high engine speed zone. Further, when the detected engine speed is between the first and second predetermined engine speeds, it is determined that it is in an intermediate engine speed zone. A fourth means sets a first value of a minimum amount of an injected fuel when the detected engine speed is in the low engine speed zone, and sets a second value which is less than the first value when the detected engine speed is in the high engine speed zone. When the detected engine speed is in the intermediate engine speed zone, the fourth means maintains one of the first or second value which is already set. A fifth means determines an amount of an injected fuel according to the amount of the intake air and the engine speed detected by the air flow meter and the engine speed sensor respectively. When the determined amount of an injected fuel is less than the minimum amount set by the fourth means, the fifth means determines the minimum amount of the injected fuel set by the fourth means as a final minimum amount of the fuel. When the determined amount of an injected fuel is greater than the minimum amount set by the fourth means, the fifth means determines the determined amount of the injected fuel as a final amount of an injected fuel. Finally, the amount of the fuel calculated by the fifth means is injected by a sixth means into the engine.

BRIEF DESCRIPTION OF THE DRAWINGS

The above objects, features and advantages of the present invention will become more apparent from the following description of the preferred embodiments taken in conjunction with the accompanying drawings, wherein.

DETAILED DESCRIPTION OF THE PREFERRED EMBODIMENTS

The present invention is described in detail with reference to the accompanying drawings which illustrate different embodiments of the present invention.

Figure 1:
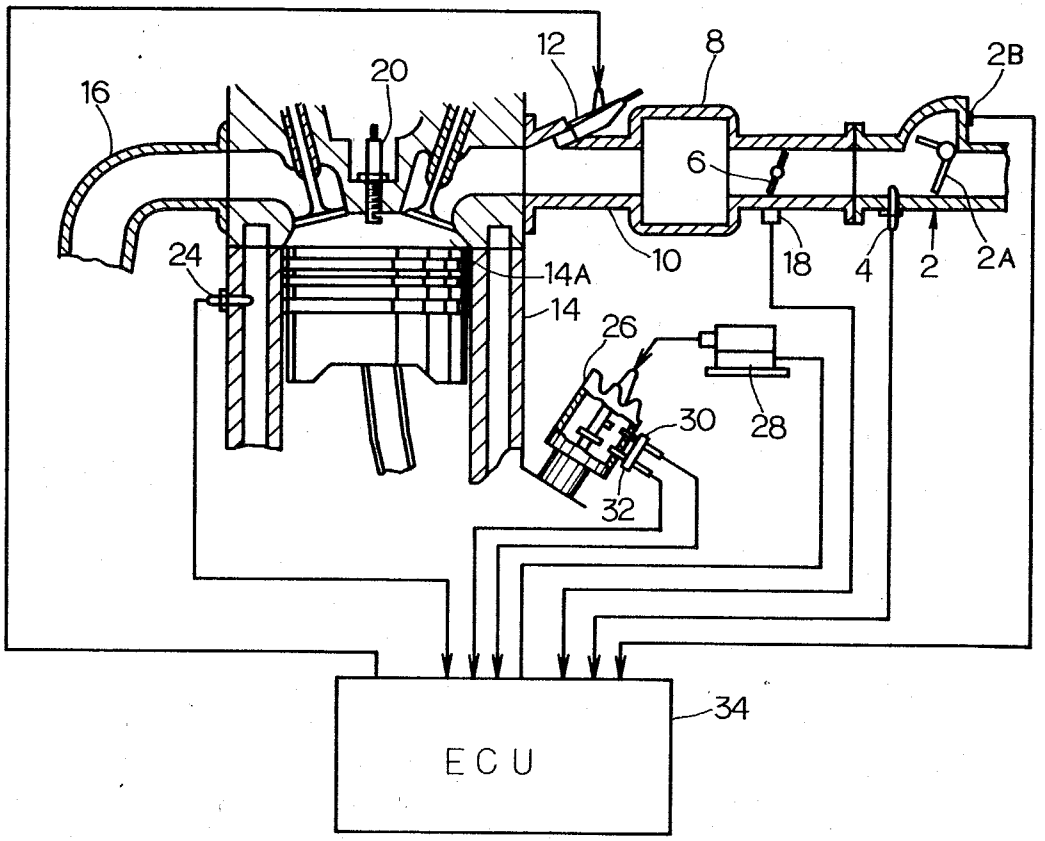
FIG. 1 is a partially schematic view of an internal combustion engine installed with a fuel injection control apparatus according to the present embodiment of the invention.

FIG. 1 illustrates a partially schematic view of an internal combustion engine installed with a fuel injection control apparatus according to the present embodiment of the invention. An air flow meter 2 is provided in an intake passage defined within an intake manifold 10 and is designed to calculate the amount of air introduced into an air cleaner (not shown in drawings). The air flow meter 2 comprises a compensation plate 2A which is rotatably mounted in the intake passage, and a potentiometer 2B which detects the opening of the compensation plate 2A. The potentiometer 2B generates an analog output signal which is in proportion to the amount of the introduced air. The amount of the introduced air is outputted from the potentiometer 2B as an electric voltage. An intake air temperature sensor 4 is provided at the position in the vicinity of the air flow meter 2.

A throttle valve 6 is provided in the downstream part of the air flow meter 2. A throttle sensor 18 is provided on the intake manifold 10 at the position adjacent to the throttle valve 6 and detects the opening of the throttle valve 6. The throttle sensor 18 generates a signal which is in proportion to the opening of the throttle valve 6. A surge tank 8 is provided in the downstream part of the throttle valve 6, within the intake manifold 10. A fuel injection valve 12 is mounted on the intake manifold 10 and injects an amount of fuel into the intake passage. The intake manifold 10 is connected with a combustion chamber 14A of an engine. The combustion chamber 14A is further communicated with a catalytic converter (not shown in drawings) which contains a three-way catalyst. The numeral 20 designates a spark plug which generates an electric spark between its electrodes. An engine coolant temperature sensor 24 is mounted on a cylinder block of the engine and detects the temperature of the engine coolant which is filled in an engine coolant jacket. The engine coolant temperature sensor 9 generates an analog output signal which is in proportion to the engine coolant temperature.

The spark plug 20 is connected with a distributor 26 which is connected with an ignitor 28. In the distributor 26, a cylinder distincting sensor 30 and an engine speed sensor 32 are provided. Each of the sensors 30 and 32 comprises a pickup and a signal rotor fixed onto a distributor shaft. If the engine is a four-cylindered engine, the cylinder distincting sensor 30, issues the cylinder distincting signal by every 180° of a crank angle and outputs it into an electronic control unit 34 (herein referred to as ECU). If the engine is a six-cylindered engine, the cylinder distincting sensor 30 issues the cylinder distincting signal by every 120° of the crank angle. The engine speed sensor 32 generates a crank angle signal by every 30° of the crank angle and outputs the crank angle signal to the ECU 34.

Figure 2:
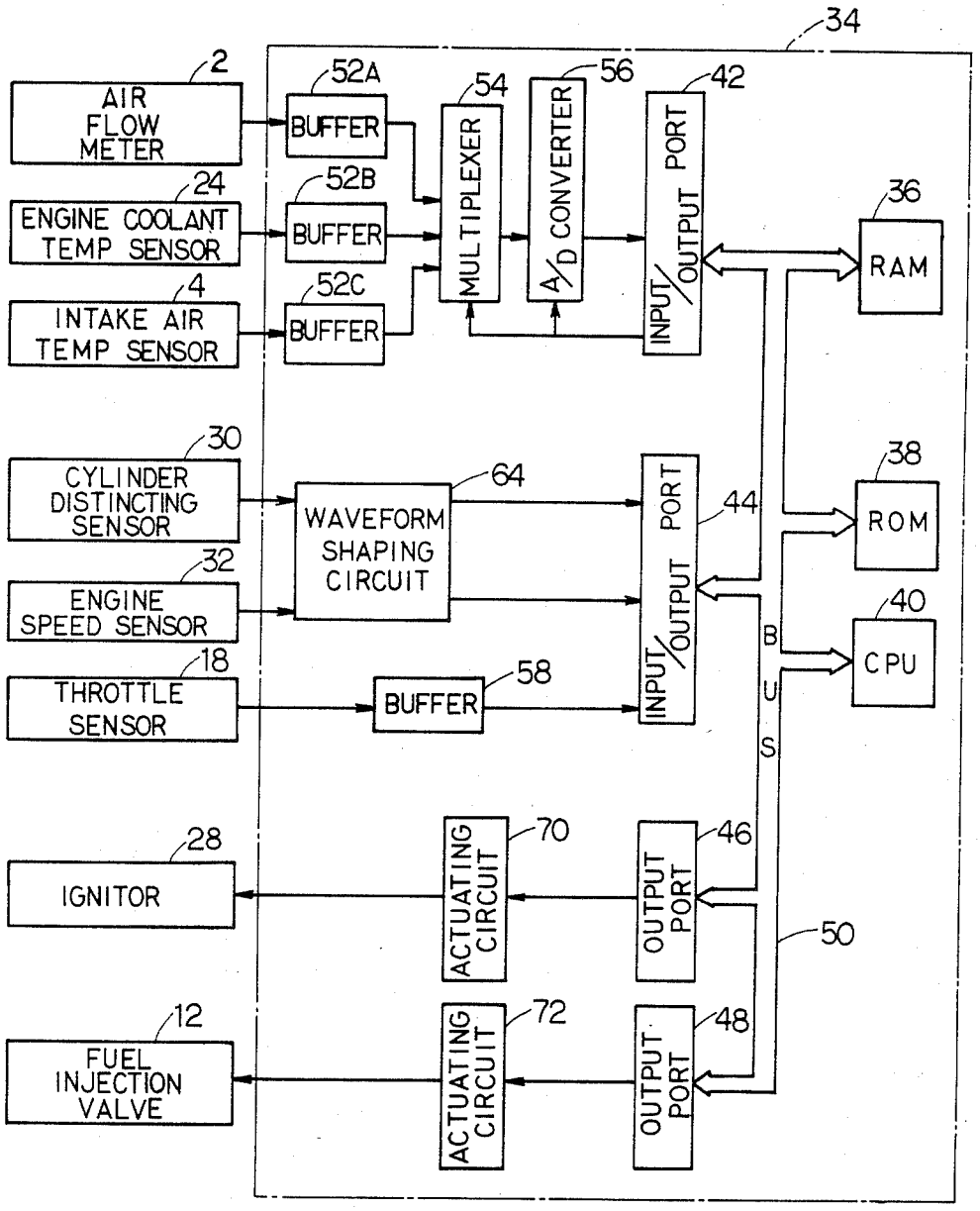
FIG. 2 is a circuit diagram of the electronic control unit illustrated in FIG. 1.

FIG. 2 shows a circuit diagram of the ECU 34 illustrated in FIG. 1. The ECU 34 functions as a digital computer and comprises a central processing unit 40 (hereinafter referred to as CPU) which carries out the arithmetic and logic processing means, a random-access memory 36 (hereinafter referred to as RAM) which temporarily stores the calculated data of the CPU 40, a read-only memory 38 (hereinafter referred to as ROM) which stores a predetermined control program and arithmetic constants therein, a first input/output port 42, a second input/output port 44. A bus 50 connects the elements among the RAM 36, the ROM 38, the CPU 40, the first input/output port 42, the second input/output port 44, a first output port 46 and a second output port 48.

The first input/output port 42 is connected with the air flow meter 2, the engine coolant temperature sensor 24 and the intake air temperature sensor 4 through an analog/digital converter 56, a multiplexer 54 and buffers 52A, 52B, 52C. The multiplexer 54 and the analog/digital converter 56 are controlled by the signals which are outputted from the first input/output port 42, and convert the analog data detected by the air flow meter 2, the engine coolant temperature sensor 24 and the intake air temperature sensor 4 into the digital signal. The converted digital signals are stored in the CPU 40 or the RAM 36.

The second input/output port 44 is connected with the cylinder distincting sensor 30 and the engine speed sensor 32 through a waveform shaping circuit 64. Further, the second input/output port 44 is connected with the throttle sensor 18 through a buffer 58. The first output port 46 is connected with the ignitor 28 through a first actuating circuit 70. The second output port 48 is connected with the fuel injection valves 12 through a second actuating circuit 72.

The ROM 38 memorizes maps of a basic spark advance and an amount of a basic fuel injection which are indicated by the engine speed and the amount of the intake air. The CPU 40 reads the basic spark advance and an amount of a basic fuel injection by the signals from the air flow meter 2 and the engine speed sensor 32. The read basic spark advance and an amount of a basic fuel injection are corrected by the various kinds of signals including the signals from the engine coolant temperature sensor 24 and the intake air temperature sensor 4. The ignitor 28 and the fuel injection valves 12 are controlled by the corrected signals. Thus, the spark advance and the amount of the injected fuel are controlled by the program stored in the ROM 38. Next, a fuel injection period $\tau$ is explained in conjunction with the flow chart shown in FIG. 3.

Figure 3:
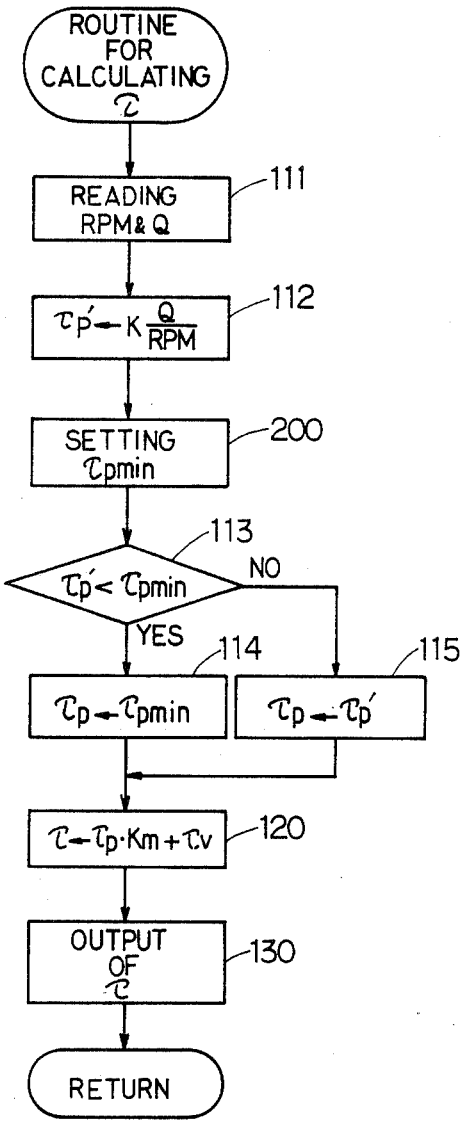
FIG. 3 is a flow chart which illustrates the operation of the apparatus according to the present embodiment of the invention.

The program shown in FIG. 3 is an interruption routine which is carried out at every time when the cylinder distincting sensor 30 issues a cylinder distincting signal. When the routine commences to calculate the injection time period upon the issue of the cylinder distincting signal, in step 111, the engine speed RPM and the amount of the suctioned intake air detected by the engine speed sensor 32 and the air flow meter 2, respectively, are read. The program proceeds to a step 112, wherein a basic fuel injection period $\tau_p$ is calculated according to the amount of the suctioned intake air Q and the engine speed RPM. The program proceeds to a step 200, wherein a minimum amount of the injected fuel $\tau_{pmin}$ is set. According to the present embodiment, the minimum amount of the injected fuel $\tau_{pmin}$ is set to two predetermined values which are selected by the engine speed.

Figure 5:
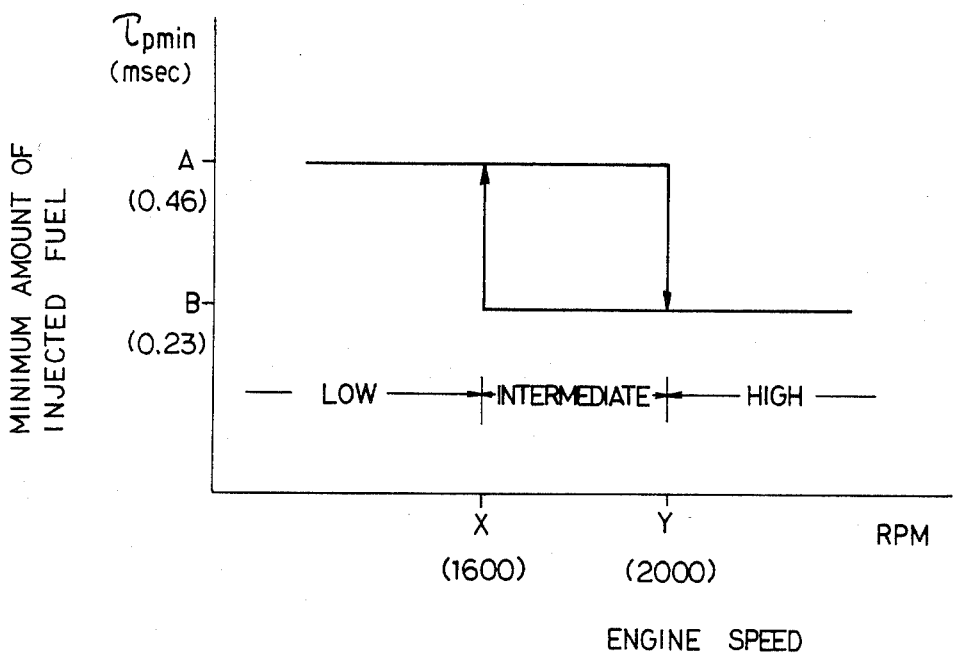
FIG. 5. is a graph which indicates the minimum amount of the injected fuel.

FIG. 5 shows a graph which illustrates the minimum amount of the injected fuel. When an engine speed increases from a low engine speed zone which is less than a first engine speed X (for example, 1600 RPM) to a high engine speed zone which is greater than a second engine speed Y (for example, 2000 RPM), a first predetermined value A (for example, 0.46 msec) is adopted during the low and intermediate engine speed zones defined between the first and second engine speeds X, Y. When the engine speed increases to exceed the second engine speed Y, the second predetermined value B is adopted as the minimum amount of the injected fuel.

Contrary to this, when the engine speed drops from the high engine speed zone to the low engine speed zone, the second predetermined value B is adopted during the high and intermediate engine speed zones. When the engine speed further drops and is in the low engine speed zone, the first predetermined value A is adopted as the minimum amount of the injected fuel instead of the second predetermined value B.

Figure 4:
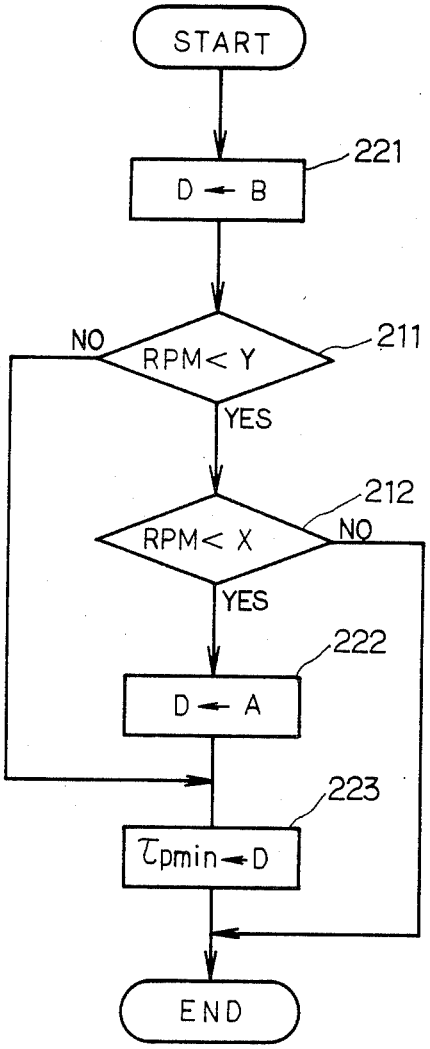
FIG. 4 is a flow chart which illustrates the operation of the apparatus according to the present embodiment of the invention.

The minimum amount of the injected fuel $\tau_{pmin}$ is explained in conjunction with FIG. 4. In step 221, the second predetermined value B of the minimum amount of the injected fuel is stored in a register D. In steps 211 and 212, it is determined to which engine speed zone the engine speed belongs. In step 211, it is determined whether or not the engine speed is less than the second engine speed Y. When the engine speed is greater than the second engine speed Y, the program proceeds to step 223. In this condition, it is determined that the engine speed belongs to the high engine speed zone. Contrary to this, when the engine speed is less than the second engine speed Y, the program proceeds to step 212, wherein it is determined whether or not the engine speed is less than the first engine speed X. If the engine speed is less than the first engine speed X, the program proceeds to step 222. In this condition, it is determined that the engine speed belongs to the low engine speed zone. If the engine speed is greater than the first engine speed X, the program ends. In this condition, it is determined that the engine speed belongs to the intermediate engine speed zone. If it is determined in step 212 that the engine speed is less than the first engine speed X, the program proceeds to step 222, wherein the first predetermined value A of the minimum amount of the injected fuel $\tau_{pmin}$ is stored in the register D. As apparent from FIG. 5, the first predetermined value A of the minimum injection amount is designed to be greater than the second predetermined value B. For example, the first predetermined value A is 0.46 millisecond (msec.), and the second predetermined value B is 0.23 millisecond (msec.). In a step 223, the value stored in the register D is set as the minimum amount of the injected fuel $\tau_{pmin}$. When the first predetermined value A is stored in the register D, the minimum amount of the injected fuel is the amount determined by the first predetermined value A. When the second predetermined value B is stored in the register D, the minimum amount of the injected fuel is the amount determined by the second predetermined value B. In the register D, if the engine speed belongs to the high engine speed zone, it is determined in step 211 that the result is NO and the second predetermined value B is stored. If the engine speed belongs to the low engine speed zone, it is determined in the step 212 that the result is YES, and the first predetermined value A is stored in the register D. If the engine speed belongs to the intermediate engine speed zone, it is determined that the result in the step 211 is YES and the result in the step 212 is NO. Hence, the another minimum amount of the injected fuel is not set in the step 223, and the already set minimum amount of the injected fuel $\tau_{pmin}$ is still maintained.

Thus, as a result that the minimum amount of the injected fuel is set, when the engine speed gradually drops from the speed higher than the second engine speed Y under the effect of the engine brake, the minimum amount of the injected fuel $\tau_{pmin}$ is converted to the first predetermined value A after the engine speed drops down to the first engine speed X. During the high and intermediate engine speed zone, the minimum amount of the injected fuel is set to the second predetermined value B. Hence, when the engine speed drops from the high engine speed zone, the emission of the noxious content, which is contained in the exhaust gas, is decreased.

When the engine speed temporarily increases, the minimum amount of the injected fuel $\tau_{pmin}$ is maintained as the first predetermined value A unless the increased engine speed does not exceed the second engine speed Y, and is not converted to the second predetermined value B. Hence, the torque fluctuation, which generates at the time when the engine speed decreases, can be decreased.

While the present invention has been described in its preferred embodiments, it is to be understood that the invention is not limited thereto, and may be otherwise embodied within the scope of the following claims.

What is claimed is:

1. A fuel injection control apparatus for use of an engine, comprising:

a first means for detecting an amount of an intake air which is suctioned into the engine;

a second means for detecting an engine speed;

a third means for determining whether the detected engine speed is in a low engine speed zone whose speed is less than a first predetermined engine speed, whether the detected engine speed is in a high engine speed zone whose speed is greater than a second predetermined engine speed which is set to be greater than the first predetermined engine speed, or whether the detected engine speed is in an intermediate engine speed zone whose speed is between the first and second predetermined engine speeds;

a fourth means for setting a minimum amount of an injected fuel according to the engine speed zone determined by the third means, the fourth means setting a first value when the third means detects that the detected engine speed is in the low engine speed zone, and a second value whose value is less than the first value when the third means detects that the detected engine speed is in the high engine speed zone, further the fourth means maintaining the first value in the intermediate engine speed zone when the engine speed increases from the low engine speed zone and the second value in the intermediate engine speed zone when the engine speed drops from the high engine speed zone;

a fifth means for determining an amount of an injected fuel according to the amount of the intake air and the engine speed detected by the first and second means respectively, the fifth means determining the minimum amount of the injected fuel set by the fourth means as a final minimum amount of the injected fuel when the determined amount of the injected fuel is less than the minimum amount set by the fourth means, further the fifth means determining the determined amount of the injected fuel as a final amount of an injected fuel when the determined amount of the injected fuel is greater than the minimum amount set by the fourth means; and a sixth means for injecting the amount of fuel calculated by the fifth means.

2. The fuel injection control apparatus of claim 1, wherein the first means for detecting an amount of an intake air is an air flow meter.

3. The fuel injection control apparatus of claim 1, wherein the first and second predetermined engine speeds of the third means are 1600 and 2000 RPM, respectively.

4. The fuel injection control apparatus of claim 1, wherein the first and second values of a minimum amount of an injected fuel are 0.46 and 0.23 millisecond, respectively.

* * * * *